United States Patent [19]

Erixon

[11] 4,107,453

[45] Aug. 15, 1978

[54] WIRES AND TWO-PART ELECTRICAL COUPLING COVER

[75] Inventor: Berthold Erixon, Gyttorp, Sweden

[73] Assignee: Nitro Nobel, Gyttorp, Sweden

[21] Appl. No.: 710,594

[22] Filed: Aug. 2, 1976

[30] Foreign Application Priority Data

Sep. 2, 1975 [SE] Sweden ..... 7509718

[51] Int. Cl.[2] ..... H01R 5/08; B21F 7/00; B21F 15/04

[52] U.S. Cl. ..... 174/87; 102/28 R; 140/119; 403/214

[58] Field of Search ..... 174/84 S, 87, 91, 94 S, 174/74 A, 93; 102/28 R, 28 S; 140/118, 119, 120, 149; 403/206, 209, 214, 243, 286, 293, 305, 308, 361; 138/89, 96 R; 220/352, 356; 285/DIG. 2; 229/93

[56] References Cited

U.S. PATENT DOCUMENTS

| | | | |
|---|---|---|---|
| 2,416,943 | 3/1947 | Nicolazzo | 174/87 |
| 2,941,562 | 6/1960 | Ripin | 220/352 X |
| 2,943,650 | 7/1960 | Rubin | 140/119 |
| 3,109,051 | 10/1963 | Vogel | 174/87 |
| 3,127,011 | 3/1964 | Weddle | 229/93 X |
| 3,610,288 | 10/1971 | Carr | 138/96 R |
| 3,806,630 | 4/1974 | Thompson et al. | 174/93 X |
| 3,838,206 | 9/1974 | Eklund | 174/87 |

*Primary Examiner*—Laramie E. Askin
*Attorney, Agent, or Firm*—Hane, Roberts, Spiecens & Cohen

[57] ABSTRACT

An electrical coupling cover where a first inner cover having first and second open ends is overlapped by a second outer cover also having first and second open ends. Two electrical wires having bare ends are inserted through the inner cover when in use and bent around onto the outer surface thereof where the second cover clamps the bare ends in place by sliding contact. After clamping, the covers are rotated in order to twist the bare ends together for electrical connection.

2 Claims, 5 Drawing Figures

WIRES AND TWO-PART ELECTRICAL COUPLING COVER

BACKGROUND OF THE INVENTION

The present invention refers to an electrical coupling cover. The purpose of such coupling covers is to connect electrically two peeled-off ends of conducting wires with each other, such as through coupling together or twisting. In the U.S. Pat. No. 3,838,206, there is described how two ends of peeled-off conducting wires are twisted together. According to the patent, a peeled-off end of the conducting wire is inserted into a cover and then is fixed to the inner wall of the cover. When this has been done, another conducting wire with a peeled-off end is inserted. When the cover is rotated, a twisting together of the conducting wires is obtained so that a fine electrical contact is acquired. According to the patent, the device works perfectly, however it is a little expensive to get the fixing of one of the conducting wires.

SUMMARY OF THE INVENTION

The present invention refers to a coupling cover of the lastmentioned type, where the peeled-off ends of the conducting wires are joined together by means of twisting. The purpose of the invention is to obtain a more simple and considerably cheaper fixing of the end of the conducting wire which is to be firmly fixed to the cover.

According to the invention, this is obtained by inserting a peeled-off end of a conducting wire into a cover which is open at both ends. At the end which is not the mouth, the peeled-off end of the conducting wire is bent so that part of the wire is outside the shell surface of the cover. Another cover is pulled on, which has an inside diameter which is a little larger than the outside diameter of the first cover. Through the pulling-on, the inserted end of the conducting wire is firmly locked. When this has been done, another conducting wire with peeled-off end is inserted. By rotating the connected cover unit a twisting together of the two ends of conducting wire is obtained.

According to the invention, it should be obvious that two ends of conducting wire, which are to be connected, can both be inserted into the cover mentioned and then be bent, so that both of the peeled-off ends will be firmly locked after the pulling-on of the other cover. Through rotation of the cover unit, a twisting together of the two ends of wire is obtained.

The two covers could have any suitable cross section. However, it would be suitable to have a cross section in the form of a polygon, as it is easier to rotate the cover unit in connection with the twisting of the wires.

According to the invention, the pulled-on cover is equipped with a transverse wall, which is situated between the ends of the cover or at one end of the cover.

According to the invention, the two covers can be made of any suitable material. Plastics, metal, cardboard, wood, and similar materials may be used.

If the two covers, according to the invention, are made of plastics it should be suitable to make them as a single coherent unit which can easily be separated into two covers at the place of work by breaking them apart.

BRIEF DESCRIPTION OF THE DRAWING

The present invention will be described in detail in connection with the enclosed drawings, wherein.

DETAILED DESCRIPTION OF THE INVENTION

Figure 1:
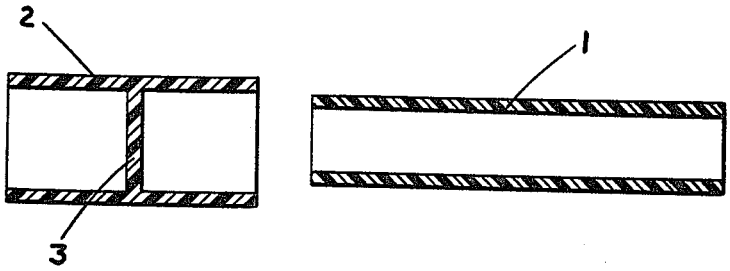
FIG. 1 shows two covers according to the present invention.
Figure 2:
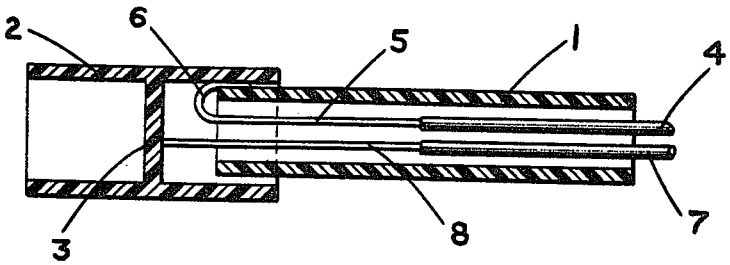
FIG. 2 shows the two covers mentioned together with two conducting wires before the twisting together.

In FIG. 1 is shown a cover of circular cross section. The cover is intended to work together with another cover 2, which also has a circular cross section, but where the inside diameter is slightly larger than the outside diameter of cover 1. Cover 2 has a transverse wall 3. This wall can also be situated in the left-hand end of cover 2. The two covers 1 and 2 are suitably made of plastics. According to the invention and according to the shape of construction, the two covers cannot only have a circular cross section but they can very well have the shape of a hexagon or an octagon. The two covers 1 and 2 can be made in a single unit, so that the left-hand end for cover 1 is connected with the right-hand end for cover 2 and at the point of connection equipped with a breaking line. At the working place, the user of the covers will insert a conducting wire 4, which has a peeled-off end 5. The conducting wire is inserted through the right-hand end of the cover and the peeled-off end is bent at the left-hand end of the cover. The bent end of the wire has got the reference indication 6. When the wire has been bent, the cover 2 will be pulled on cover 1 and thus the bent part 6 will be jammed, which results in the fact that the conducting wire 4 will be firmly fixed in the cover units 1 and 2, which are now joined together. The transverse wall 3 prevents the cover 2 from being pulled too far onto cover 1. In the situation now described, the conducting wire is inserted with its peeled-off or stripped part 8. This will appear clearly from FIG. 2. When this has taken place, the connected cover unit will be rotated round its longitudinal axis so that the stripped parts 5 and 8 are twisted together and a fine electrical contact is obtained between the two conducting wires 4 and 7. It is obvious that it would be advantageous if the two covers 1 and 2 have a polygonal cross section, as the two covers 1 and 2 thus cannot be rotated relative to each other. Further, the polygonal shape will facilitate the rotation of the connected cover unit.

Figure 3:
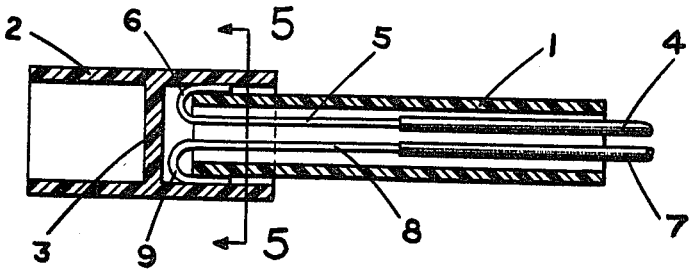
FIG. 3 also shows the two covers before the twisting together of the two conducting wires and where the two conducting wires are firmly locked.
Figure 5:
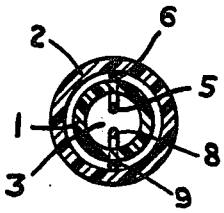
FIG. 5 is a cross-sectional view taken along line 5—5 of FIG. 3.
Figure 4:
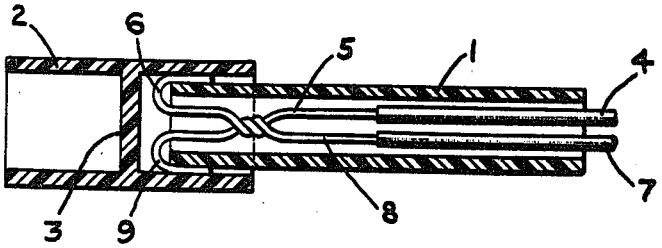
FIG. 4 is a view similar to FIG. 3 but with the wires twisted together.

So far there has been described the fixing of one of the conducting wires to the cover. However, it should be obvious that it is possible to firmly lock the two ends of the conducting wires which are to be twisted together. In FIG. 3, it can be seen how both the stripped part 5 of conducting wire 1 has a bent part 6 and also how the stripped part 8 of conducting wire 7 has a bent part 9. The two firmly fixed conducting wires 4 and 7 will get electrical contact with each other through the rotation of the connected covers 1 and 2 round the longitudinal axis.

I claim:

1. In combination, two insulated electrical wires each having a bare end and a electrical coupling cover for the connection of said two insulated electrical wires, comprising: a first cover portion having a first open end and a second open end spaced from said first open end, said first cover portion having a hollow interior for the insertion therethrough of the bare ends of the two electrical wires, said first cover portion having an outer diameter; and a second cover portion of similar shape as said first cover portion and comprising an open end and a transverse wall spaced from said open end of said second cover portion, said second cover portion also having a hollow interior defined by an inner diameter thereof, said inner diameter being slightly larger than said outer diameter of said first cover portion, said second open end of said first cover portion being inserted into said open end of said second cover portion, said transverse wall preventing the insertion of said first cover portion into said second cover portion past a certain point, said first cover portion being of the same cross-sectional dimension throughout the length thereof, said second cover portion also being of the same cross-sectional dimension throughout the length thereof, the inner and outer surfaces of each of said first and second cover portions being smooth throughout, the bare ends of the two electrical wires being inserted through said first cover portion toward said second open end of said first cover portion and made to extend therebeyond, at least one of the ends of said bare ends being bent over said second open end of said first cover portion onto the outer smooth surface thereof, the difference in diameter between the first and second cover portions being related to the diameter of the bent bare end of the wires such that with said first cover portion with said bare wire end bent thereover inserted into said inner surface of said second cover portion said bent end is clamped in place by said first and second cover portions so that upon rotation of said cover portions together, said two electrical wires are twisted together for electrical contact.

2. The combination according to claim 1, wherein said cover portions are made entirely throughout of plastic material.

* * * * *